United States Patent [19]

Connors et al.

[11] 4,437,584

[45] Mar. 20, 1984

[54] TOOTHPASTE DISPENSER

[75] Inventors: Stephen T. Connors, Sale; Harvey, Kenneth, Wilmslow, both of England

[73] Assignee: Colgate-Palmolive Company, New York, N.Y.

[21] Appl. No.: 297,289

[22] Filed: Aug. 28, 1981

[51] Int. Cl.[3] ..... B67D 5/52

[52] U.S. Cl. ..... 222/137; 222/391

[58] Field of Search ..... 222/390, 391, 322, 320, 222/392, 136, 137; 401/176–180

[56] References Cited

U.S. PATENT DOCUMENTS

| | | | |
|---|---|---|---|
| 1,299,487 | 4/1919 | Loeben | 222/391 |
| 2,557,952 | 6/1951 | Dumont | 222/391 |
| 2,789,731 | 4/1957 | Marrafino | 222/94 |
| 3,255,935 | 6/1966 | Spatz | 222/391 |

FOREIGN PATENT DOCUMENTS

| | | | |
|---|---|---|---|
| 1519772 | 4/1968 | France | 222/391 |

*Primary Examiner*—H. Grant Skaggs

*Attorney, Agent, or Firm*—Herbert S. Sylvester; Murray M. Grill; John A. Stemwedel

[57] ABSTRACT

A toothpaste dispenser comprising a container having a neck through which a tube connected to a plunger extends. A uni-directional movable plate is disposed in the container and a ratchet assembly extends through the plate for moving the plate to extrude product through the tube. A spring returns the plunger to its initial position.

6 Claims, 6 Drawing Figures

TOOTHPASTE DISPENSER

BACKGROUND OF THE INVENTION

1. Field of the Invention

This invention relates to a toothpaste dispenser, and more particularly to a freely standing packaging device for administering a ribbon of dental cream or like product.

2. Description of the Prior Art

Traditionally dental creams are packaged in collapsible aluminum or laminated tubes. Rigid freely standing packages have now come into use and are now being sold in West Germany under the trademark "Theramed". The packaging device so employed is disclosed in German Patent No. 1,210,140.

Various other types of packaging using pumping means for dispensing dental cream have been devised. In U.S. Pat. No. 2,604,858 to Bosa there is dispensed a ratchet assembly for use in a pump type dispenser. Various types of dispensers for dispensing striped cream products have also been devised such as shown in U.S. Pat. No. 2,789,731 to Marraffino, and in U.S. Pat. No. 3,608,782 to Sethieq.

The prior art fails to provide for a simple, aesthetically pleasing, free standing toothpaste dispenser that employs ratchet means for moving a uni-directional movable semi-flexible plate to extrude toothpaste in a predetermined amount with little loss, while being simple to manufacture, and capable of being manufactured from plastic materials thus avoiding chemical reactions as occur in aluminum packaging.

SUMMARY OF THE INVENTION

It is therefore the primary object of this invention to provide a rigid dental cream package that is aesthetically pleasing and free-standing, which can be adapted to dispense a striped product, yet which is positive in operation, does not deform during use, and which is inexpensive to manufacture.

The present invention includes a container provided with a neck through a tube integral with a plunger and outlet extends into the interior of the container. Connected to the tube is a ratchet assembly including a uni-directional plate moved by the ratchet assembly to displace the contained product. A slotted arrangement can be provided in the tube for enabling a striped product to be extruded.

In another variation the tube is disposed about a pipe, the tube delivering product from one section of the container while the pipe delivers product from another section of the container.

DETAILED DESCRIPTION OF THE INVENTION

Figure 1:
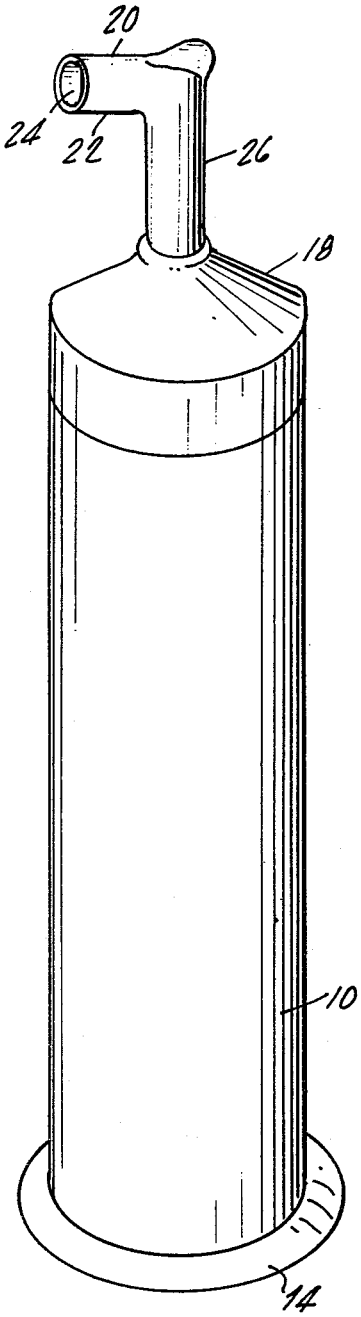
FIG. 1 is a perspective view of an embodiment of the invention.
Figure 2:
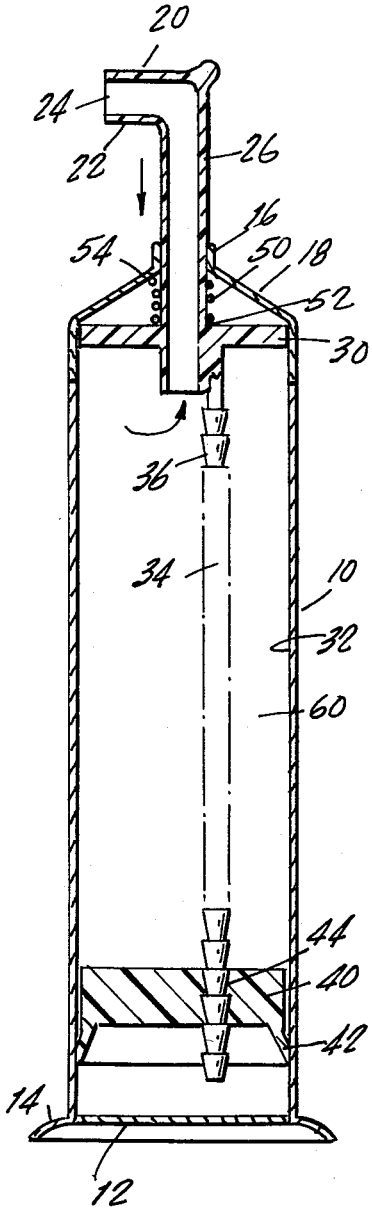
FIG. 2 is a vertical sectional view of the embodiment shown in FIG. 1.

With initial reference to the embodiment shown in FIGS. 1 and 2, the dispenser according to the invention includes a substantially rigid hollow container 10 having a base 12 provided with an outwardly extending footing 14 provided for better support for the freely standing container 10. The container 10 is provided with a neck 16 rising from an upwardly extending conical portion 18.

It is to be noted that in the embodiment of FIGS. 1 and 2, as well as all of the other embodiments of the invention the base 10 may be provided with a well, not shown, to enable the packaging of additional product without increasing the size of the package. On the other hand, when it is desired to enlarge the size of the package to permit easier handling while controlling the amount of product contained therein, the base may be shaped convex upwardly.

A plunger 20 includes an integral spout 22 having a delivery opening 24 as well as a tube 26 which fits closely and extends through the neck 16 into the interior of the container 10.

A plate 30 is integral with the tube 26 and is closely fitted to the inside surface 32 of the container 10.

A rigid rod 34 provided with serrations forming ratchet teeth 36 is attached to the plate 30 and moves with the plate 30 and tube 26.

A semi-flexible plate 40 is mounted in the container 10 and has a restraining resilient rim 42 which engages the inner surface 32 of the container so as to prevent any downward movement whatsoever of the plate 40. The teeth 36 of the rod 34 extend through an opening 44 in the plate 40 and can pass resiliently downwardly through the plate 40 but are restrained by the shape of the ratchet teeth 36 from passing upwardly of the plate 40.

A tension spring 50 is fixedly secured to the plate 30 at 52, and to the container 10 at 54 and is placed under tension when the plunger 20 is depressed.

The product 60 to be dispensed is stored in container 10. Depression of the plunger 20 through the neck 16 of the container 10 moves the plate 30 and thus the rod 34 downwardly. The product 60 is forced up through the tube 26 and out of the delivery opening 24.

Movement of the plate 30 downward causes the rod 34 to move down through the plate 40. The plate 40 is prevented from moving down with the rod 34 by the action of semi-flexible rim 42 under tension against the inner surface 32 of container 10. The rim 42 allows movement upwards, but when a downward force is applied, compresses against surface 32 and prevents plate 40 moving downward with the rod 34.

When the plunger 20 is released the spring 50 returns plate 30 back to its original position. The rod 34 then lifts plate 40 upwardly with it. In this manner the product is extruded through the discharge opening 24 and the remainder of the product 60 is moved upwardly in the container 10. The movement of the product 60 upwardly is directly related to the downward action and therefore to the amount of product extruded. The base 12 aids in concealing the operating mechanism.

Figure 5:
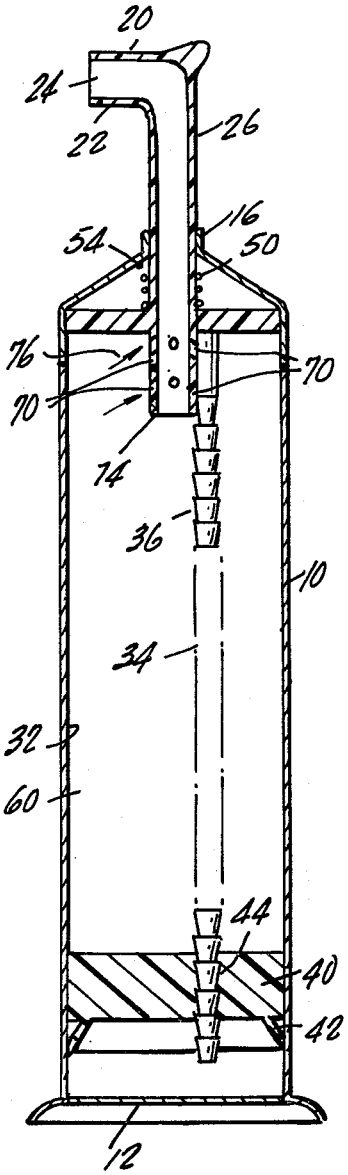
FIG. 5 is a view similar to FIG. 2, but illustrating a further modification for discharging a striped product.

Referring now to the embodiment of the invention shown in FIG. 5, the arrangement of parts is similar to the embodiment shown in FIGS. 1 and 2. This embodiment facilitates the discharge of a striped or multi-colored product by the provision of four inclined slots 70 formed in the tube 26. The container 10 is filled with the basic product to the level of the bottom periphery 74 of tube 26. The other color portion of the product is filled thereabove and passes into slots 70 in the direction of arrows 76.

Figure 3:
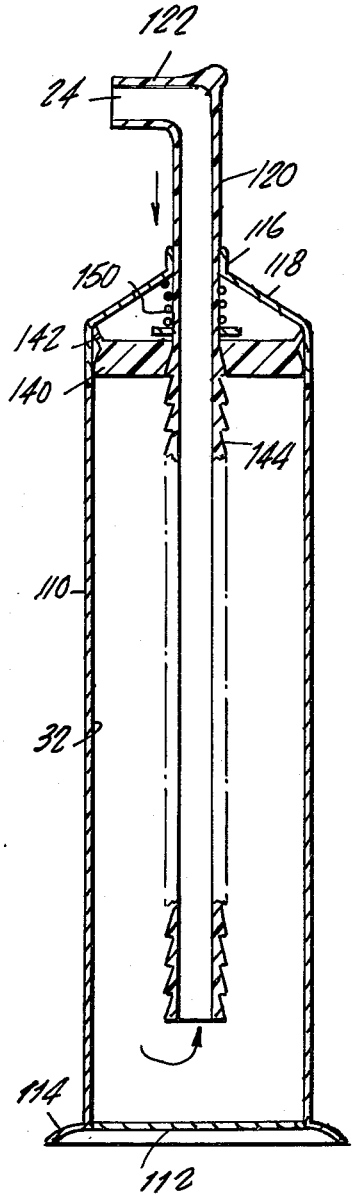
FIG. 3 is a vertical sectional view of a modified form of the invention.
Figure 4:
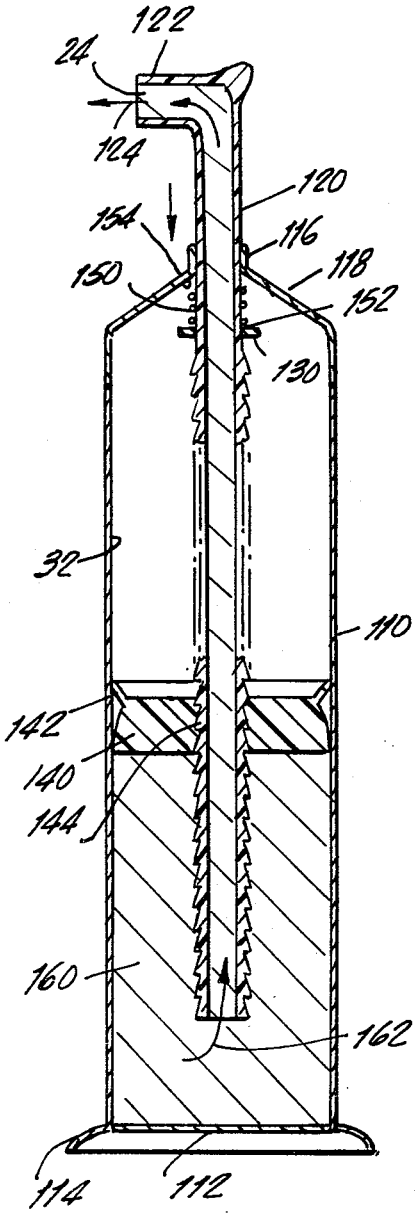
FIG. 4 is a vertical sectional view of the embodiment shown in FIG. 3 after a portion of the contents thereof have been discharged.

Referring now to the embodiment of the invention as shown in FIGS. 3 and 4, the hollow container 110 is provided with a base 112 and an outwardly extending footing 114. The container 110 has a neck 116 rising from an inwardly extending conical portion 118.

A plunger 120 includes an integral spout 122 having a delivery opening 124 as well as a tube 126 which fits closely with and extends through the neck 116 into the interior of the container 110. The lower end of the tube 126 actually lies close to the base 112 but as shown for purposes of clarity the end is spaced from the bottom to illustrate the fact that product 160 disposed in container 110 can pass into the open end of tube 126 in direction of arrow 162. The tube 126 has serrations 128 forming ratchet teeth along the lower portions below a collar plate 130 fixed to the tube 126.

A semi-flexible plate 140 has a semi-flexible 142 which engages the inner surface 132 of container 110.

The ratchet teeth are so arranged that only downward movement of plate 140 relative to the tube 126 can be achieved while rim 142 prevents upward movement of plate 140.

A tension spring 150 is secured about tube 126 and fastened at each end respectively to the plate 130 at 152 and the container 110 at 154.

Depression of the plunger 120 causes the plate 140 to be pushed down into the product 160 which is forced up the tube 126 and out of the delivery opening 124 while tensioning spring 150. Upon releasing plunger 120, the plate 140 remains in its lowered position while the tube 126 is pulled upward by spring 150. The product 160 is extruded from the container in desired amounts upon repetitive action. The position of the plate 140 can be related by comparison of FIG. 3 and FIG. 4 which shows the plate after partial extrusion of product 160 from the container 110.

Figure 6:
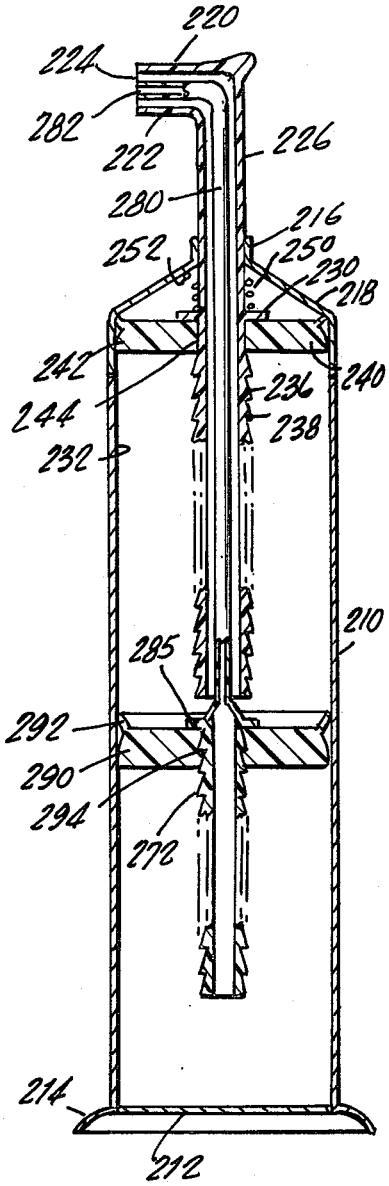
FIG. 6 is a vertical sectional view of yet another modification adapted for dispensing a striped product.

The embodiment of FIG. 6 is an adaption of this invention for extrusion of a striped product. The container 210 has a base 212 and a footing 214 and has a neck 216 rising from a conical portion 218.

A plunger 220 includes an integral spout 222 having a delivery opening 224 as well as a tube 226 which extends through the neck 216 into the interior of the container 210.

The tube 226 has serrations 228 forming ratchet teeth along the lower portion thereof below a collar plate 230 fixed to the tube 226. The tube 226 extends through an opening 244 in a first semi-flexible plate 240 which has a semi-flexible surface 242 engaging the inner surface 232 of the container 210.

A tension spring 250 is fixedly secured at 252 to the plate 230 and to the container 210 at 254.

Disposed in the tube and extending therebelow is a hollow pipe 280 having an outlet 282. The lower portion of the pipe 280 is enlarged and has an integral collar plate 285 as well as serrations 272 forming ratchet teeth which pass through opening 294 in a semi-flexible plate 290 provided with a rim 292 for preventing upward movement of the plate 290.

Product 277 of one color is disposed between plate 290 and base 212 while product 288 is disposed between plates 290 and 240.

The plates 240 and 290 are uni-directional so that product 288 travels outside of pipe 280 and product 277 travels in pipe 280 after depression of plunger 220 keeping the products apart until mixed at point of application. Each depression of plunger 220 forces both plates 240 and 290 downwardly with the plunger being returned to its initial position by action of spring 250.

What is claimed is:

1. A dispenser for delivering two products comprising a container having a neck and a bottom closure, a tube movably extending through said neck into the container and having a plunger and outlet outwardly of the container and a pipe within said tube and extending below said tube, a first uni-directional movable semi-flexible plate disposed in said container, first ratchet means connected to said tube and extending through said first plate for moving said first plate to displace a first product in said container towards said tube, a second uni-directional movable semi-flexible plate in said container, and second ratchet means on said pipe extending through said second plate for moving said second plate to displace a second product into said pipe.

2. A dispenser according to claim 1, wherein said second plate is spaced from and below said first recited plate.

3. A dispenser according to claim 1, wherein said first recited ratchet means comprises serrations on said tube.

4. A dispenser according to claim 3, wherein said second ratchet means includes serrations on said pipe.

5. A dispenser according to claim 4, wherein said second plate is spaced from and below said first recited plate.

6. A dispenser according to claim 5, including spring means about said tube for returning said plunger to an initial position while said first and second plates are retained in a lowered position.

* * * * *